US005454640A

United States Patent [19]

Welker

[11] Patent Number: 5,454,640

[45] Date of Patent: Oct. 3, 1995

[54] FLOW DIFFUSER FOR REDISTRIBUTING STRATIFIED LIQUIDS IN A PIPELINE

[76] Inventor: Robert H. Welker, P.O. Box 138, Sugar Land, Tex. 77487-0138

[21] Appl. No.: 188,458

[22] Filed: Jan. 28, 1994

[51] Int. Cl.[6] ..... B01F 15/02

[52] U.S. Cl. ..... 366/336; 138/40

[58] Field of Search ..... 366/336, 337, 366/338, 339, 340, 348, 349; 138/39, 40, 44

[56] References Cited

U.S. PATENT DOCUMENTS

| | | | |
|---|---|---|---|
| 3,207,484 | 9/1965 | Rubin | 366/336 |
| 4,614,440 | 9/1986 | King | 366/336 |
| 4,758,098 | 7/1988 | Meyer | 366/366 |
| 4,929,088 | 5/1990 | Smith | 366/336 |

*Primary Examiner*—Robert W. Jenkins

[57] ABSTRACT

A method and apparatus for distributing water in the pipeline is set forth. The pipeline water collects in the bottom and flow along the pipeline. The present disclosure sets forth a set of N tubes which have relatively small inlet and outlet openings. The several tubes joined at the inlet end, typically by tacked welding thereby defining an inlet end to gather up all of the flowing water in the pipeline which is then directed along the tubes. The outlet ends of the tubes terminate at elevated locations in the pipeline so that water droplets are entrained at selected heights in the pipeline. In one form upstream and downstream transverse members support the tubes.

A fluid flow diffuser for installation in a pipeline in advance of a fluid sampling device is set forth. A plurality of tubes is installed, the tubes having inlets collectively nested together encompasses stratified water flow on the bottom of the pipe, directing that flow along relatively long tubes which are arranged so that the outlet ends of the several tubes distribute the flowing water at different heights in the pipeline.

15 Claims, 1 Drawing Sheet

FLOW DIFFUSER FOR REDISTRIBUTING STRATIFIED LIQUIDS IN A PIPELINE

BACKGROUND OF THE DISCLOSURE

The present disclosure is directed to a flow diffuser and especially one to be used with pipelines of substantial length. When a pipeline extends several miles in length, it is not uncommon for dense liquids to settle. A typical long distance petroleum product pipeline is normally connected to a number of gathering lines which extend into a field having a number of producing wells. Each well normally produces a flow of petroleum products of densities or weights from a well. In addition, the well will typically produce a little or perhaps more than a small portion of water, and also perhaps sand or other types of sediment. Typically, a producing well is connected from the well head to a separator. A simple separator is normally a tall, relatively narrow storage tank. The storage tank sometimes called a shot gun tank. The produced petroleum products are stored in the tank for an interval. This permits sand and other sediment to collect on the bottom. In addition, any water that is mixed in the produced oil will collect at the bottom and petroleum products of less density will float on top of the water. The oil that is produced is taken from the shot gun tank near the top so that the water and sediment is left in the tank. Later the water and sediment are removed from the bottom of the tank for disposal. As a generalization, this separation process does reduce the amount of water. That is, the water is separated and is not delivered in the pipeline. Some wells produce a flow of oil and gas. The gas cut oil tends to froth and is therefore lighter and sometimes will entrain water droplets in the oil. It is also possible for minerals mixed in the oil or water to act as a detergent, thereby breaking down the surface tension and tending to emulsify the oil with water. For a variety of reasons, water is found in produced oil in some quantity. Indeed, where a number of wells connect together from an unmanned field, the amount of water which is delivered with the petroleum products can become unacceptable eventually.

The produced oil commingled with the water droplets as delivered to the pipeline is required to flow many miles in the pipeline. Especially where the fluid flow becomes fairly constant and the pipeline is substantially straight with-modest turns or obstructions, the fluid flow tends to be laminar with a minimum of turbulence. As turbulence is reduced, stratification occurs in the pipeline. Stratification is accompanied by a settling of sediment and water which are carried in the flowing oil. While the sediment may fall out and not move at all, the water tends to flow along the pipeline stratified across the bottom of the pipeline as a results of the differences in density. The denser water settles and flows along the bottom of the pipeline. The denser water is a source of inefficiency in pipeline operation. Water has no heat value and is therefore not worth pumping. While it will be delivered by the pipeline along with the more valuable petroleum based products, the water discounts the value of the petroleum products delivered through the pipeline.

Pipeline products are sold by volumetric calculations. This requires some type of flow meter to determine the fluid flow throughput of a pipeline. Stratification of the fluid flow in the pipeline poses a problem. While major efforts are made to limit the intrusion of water in the flowing products, nevertheless, some water will be captured in the fluid flow and will distort the value and usefulness of a liquid products. Water has absolutely no value. Generally, pipeline products are sold by volumetric measure. The volumetric sale transaction cannot be implemented without knowing the percentage of water that is in the flowing liquid products. When the water stratifies and collects along the bottom, it normally passes beneath or under any sampling device. A sampling device is normally needed to assay the nature of the liquid products flowing in the pipeline. The assay is particularly determined by collecting samples periodically, delivering the samples to a laboratory, and measuring the sample for heat content or some other parameter. The water mixed in the pipeline must be taken into consideration. If the water stratifies and flows beneath the sampling device it will not be sampled. Nevertheless, the water flows through the flow meter and is registered falsely, that is, the flowing water adds to the total throughput while it is not observed by the sampling device.

While the flow meter responds to the entire flow in the pipeline, the sampling device normally is positioned near the central or axial position of the pipeline. The sampling device is operated periodically to take a measured sample. For instance, a sample of 100 milliliters might be collected once per hour. The samples for an interval are collected in a separate container and are removed in that container to be carried to a testing laboratory. The testing laboratory provides an assay for the liquid flowing along the pipeline. The output data is used in determining the value of the liquid product. Assume for instance that the volume of the tested sample is overstated by one percent of valuable hydrocarbon products and is understated by one percent water. While that seems to be a trivial error, it is not uncommon for pipelines to deliver as much as 100,000 barrels per day. An error of one percent in a fluid flow throughput of 100,000 barrels per day is 1000 barrels. Assuming a value of about $20 per barrel, this represents a daily error of $20,000. That is, the purchaser is overpaying by that amount. Restated, the seller is receiving that sum of money for selling water.

The present apparatus is a system which is intended for use with a pipeline and more particularly an apparatus for redistributing stratified liquids flowing in the pipeline. While the water normally tends to settle at the bottom because of differences in density including the phase separation, the present system redistributes the water flowing along the bottom so that droplets of water are able to commingle with the flowing liquid.

An important aspect of the present disclosure is the necessity of accounting for all of the liquid delivered through the pipeline. Even though stratification may occur, the invention mixes valuable hydrocarbon components with entrained water. A mix of valuable hydrocarbons with water (pure or with salt) gives rise to a need for accounting for these. On the other hand, a portion of the liquid may be water which has no value. Restated, it has no BTU content. It is therefore necessary to change the location of sampling devices to assure that the sampling device is exposed to a mix of all constituents including the hydrocarbons and water. Since the pipeline is substantially long, the water always collects at the bottom. This locates the water excessively low for measurement. As noted, a sampling device is installed in the pipeline to take periodic samples which are then processed in a lab to provide an assay of liquid delivered by the pipeline. The sampling device must be axially positioned. If it is positioned relatively high in the pipeline, it will assuredly capture little water. If it is placed excessively low in the pipeline, the data will be skewed by capturing excessive water. There is an optimum location for the position of the sampling device, but that cannot be known because it varies dynamically with the extent of water in the hydrocarbons in the flow. Also, the optimum position will vary in a way that is dependent on production, and is also dependent on environment conditions. It is impossible to know or fix the optimum location. The sampling device typically is therefore located near the centerline axis position of the pipeline. There, it is intended to capture a representative flow, a truly representative sample. In fact, if water stratification occurs, a sample taken from the centerline axis position by the sampling device will not be representative.

The present disclosure sets forth a diffuser mechanism which assures that a representative sample can be obtained. The structure of the present disclosure sets forth a passive device which achieves mixing to reduce water stratification. Indeed, it is passive in the sense that it relies on fluid flow through the pipeline. As stratification occurs, water droplets collect along the bottom of the pipe. Water droplets on the wall of the pipe gravitate to form a water pool at the bottom. The water pool however ordinarily is not stationary. Water moves along the pipe in the form of droplets or a small stream. Because a cross country pipeline has many long straight portions, the liquid stays low along the pipeline.

As many droplets collect along the bottom, they form a flowing stream of water. The width and depth are determined by the size of the pipe and the volume of water collected in the bottom of the pipe. The present apparatus is intended for use with a pipeline which distributes the water in droplet form back into the flowing petroleum. While the water may have an instantaneous velocity which is less than the average velocity, when it is entrained as a droplet, it tends to flow at approximately the same velocity. Moreover, entrained droplets scattered through the flowing petroleum tend to establish an equilibrium. As the surface area of the water droplets is increased, mixing is enhanced, and the present apparatus is a system which accomplishes that. As will be detailed hereinafter, the device of the present system utilizes a number of small tubes which are located in a group or cluster in the pipeline to accomplish the distribution of water liquid into entrained droplet form at various elevations in the pipe, thereby reassuring a fair sampling process.

The following patents were located by a search:

| U.S. Pat. No. | Patentees |
|---|---|
| 3,582,048 | Sarem |
| 3,583,678 | Harder |
| 3,860,217 | Grout |
| 4,403,517 | Thomte |
| 4,494,413 | Bukkems, et al |
| 4,971,450 | Gerich |

U.S. Pat. No. 3,582,048 discloses a mixing conduit. It is installed in a system which cannot handle 100% of the volumetric capacity.

U.S. Pat. No. 3,583,678 is similar to the prior reference in that it shows in various views a full scale pipeline which is partly plugged by the transverse structures. While it is more like a geometry dissertation, it cannot provide a structure of any significance to pipeline mixing equipment in conjunction with a downstream measuring device.

U.S. Patent 3,860,217is a type of mixing device, note the sectional views of FIGS. 3, 7, 9, etc. It is somewhat remote compared to the earlier two references.

U.S. Pat. No. 4,403,517 shows an insert 11 in the pipe 5 which is a static vane mixer having fixed blades to cause turbulence, note Column 3.

U.S. Pat. No. 4,494,413 discloses a sampling apparatus for handling a flow of stratified fluid, note the background discussion in Column 1. If anything, this is an expensive system which provides a very extravagant answer to the problem.

U.S. Pat. No. 4,971,450 shows a solid body which blocks flow. It is limited in volume.

BRIEF SUMMARY OF THE PRESENT DISCLOSURE

The present disclosure is summarized as a set of tubes which collectively have inlet ends arranged as a group to intercept water flow stratified in the bottom of a pipeline. They extend along the pipeline and terminate in randomly scattered positions at different heights in the pipeline. At the inlet end, the lines are grouped and supported by a support such as a mesh wire insert. At the downstream end, the second support is incorporated, and the preferred form is again is a mesh insert. This set of tubes enables redistribution of entrained droplets to be scattered across the height of the pipeline to assure proper distribution for sampling.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in appended drawings.

DETAILED DESCRIPTION OF THE PREFERRED EMBODIMENT

Figure 1:
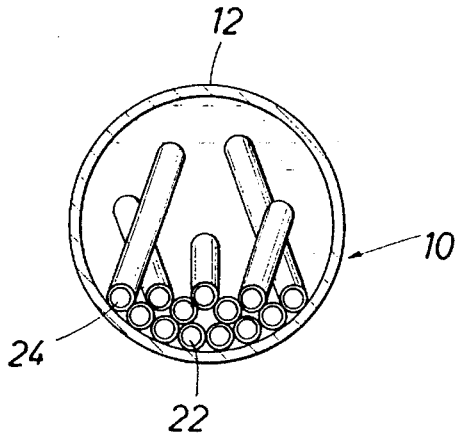
FIG. 1 is a cross-sectional view through a pipeline which is subjected to stratified flow showing a bundle of tubes therein which intercept the stratified flow at the bottom of the pipeline for redistribution to other heights in the pipe.

Attention is first directed to FIG. 1 of the drawings where the numeral 10 identifies the present invention which is positioned in a pipeline 12. The pipeline 12 is of substantial length and diameter. Indeed, it can be a pipeline which is several miles long and even part of a pipeline which is 1000 miles in length or greater. Typically, long pipelines are formed by short segments of about 50 miles connected between pump stations. It is not uncommon for such a pipeline to extend across country passing over all terrain encountered. For purposes of description, and to spell out the problem in graphic detail, assume that the pipeline is connected to a number of wells producing mostly petroleum and some small amount of water. In the long pipeline, the water will settle and collect in the bottom, form a flowing set of droplets or a bottom located stream.

Figure 2:
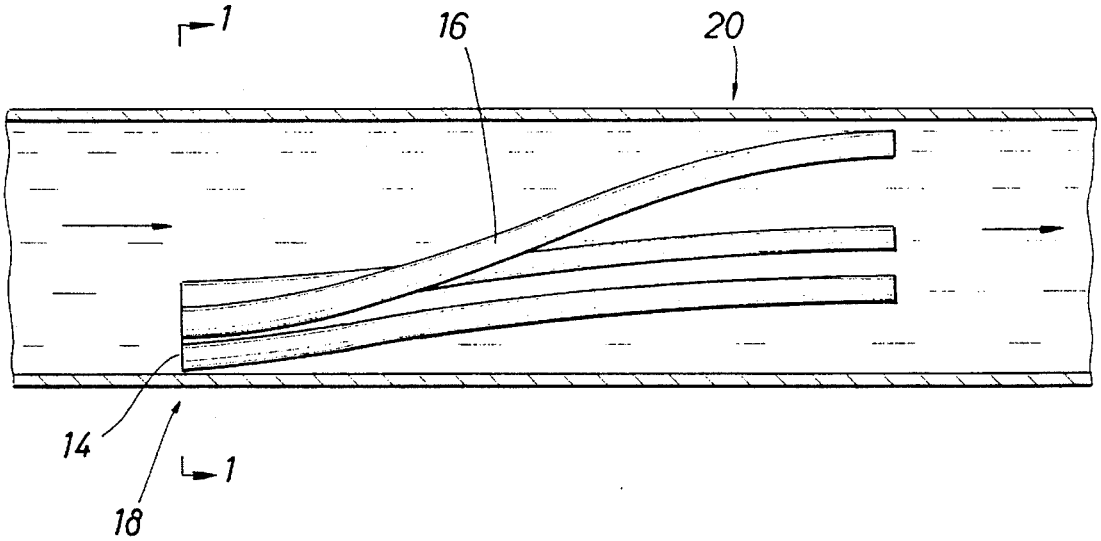
FIG. 2 is a side view of the pipeline shown in FIG. 1 showing how the several tubes extend to different heights in the pipeline and the several tubes have substantial length.

Going now to FIG. 2 of the drawings, the numeral 14 identifies a first tube, and a second tube is identified by the numeral 16. As shown in FIGS. 1 and 2 jointly, the inlet ends arranged collectively at 18 are deployed so that any liquid accumulating on the bottom of the pipeline 12 is directed into one of the tubes. The velocity of the fluid flow into the pipeline is substantial, typically at least about 3 feet/sec up to as much as about 15 feet/sec. Usually, the flowing petroleum flows over the liquid (water) sediment in the bottom of the pipe but the water is not very deep. The water collects at the bottom so that the water is directed into the inlet ends 18 of the several tubes. The water is observed to flow at the urging of the overburden of petroleum in the pipeline 12 so that the liquids introduced into each of the tubes are directed downstream utilizing the liquid flow as the impetus for movement, and the flowing water collected at the bottom of the pipe is thus distributed in the pipe.

Figure 3:
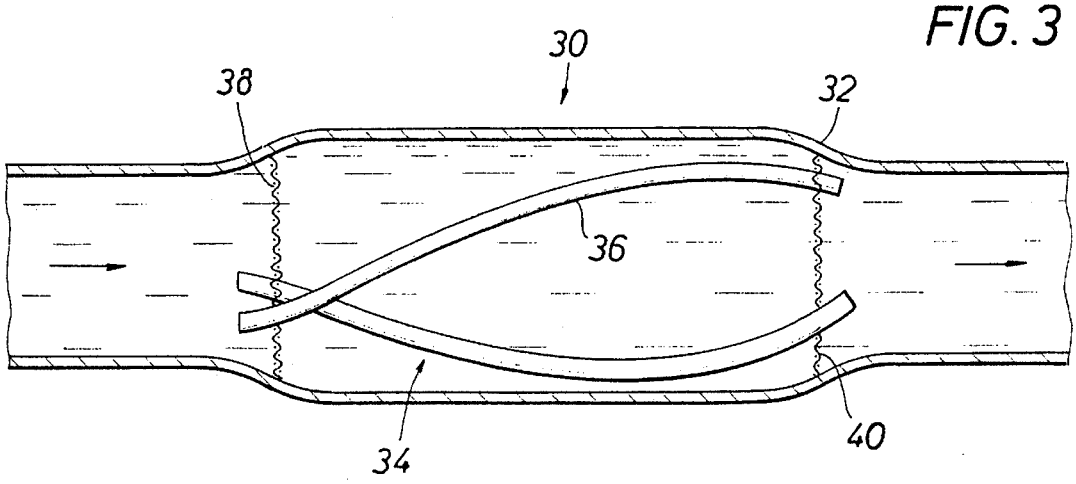
FIG. 3 is a side view of an alternate embodiment of the present invention showing transverse inserts at two locations to stabilize the tubes in the pipeline for distribution of fluid flow at other regions of the pipeline.

The inlet ends of the several tubes are joined together at a common inlet location as shown at 18 of the drawings. The bottom portion of the circular cross-sectional area of the pipe collects the water. When positioned at this bottom location, the inlets are preferably joined together for example by spot welding the tubes to each other. Adjacent tubes are welded to adjacent tubes. While the tubes are joined, it is not essential all of the outlet ends 20 be arranged precisely as illustrated in FIG. 3 of the drawings. Different tubes can terminate at different heights in the pipe. The several tubes mix water flowing along the pipeline in the form of droplets through a passive structure. The several tubes are thus joined together at a common location, and extend towards the upper portion of the pipe in a fashion to mix and redistribute the water flow through the pipeline.

FIGS. 1 and 2 jointly show several inlet ends 18 spanning the bottom area to collect any water gravitated to the bottom and to redistribute water droplets under the urging of the flow preceding from left to right in FIG. 2 of the drawings. Moreover, the tubes locate the several outlet ends to redistribute the fluid flow across the height of the pipe. For instance, the tube 22 takes stratified liquid from the bottom of the pipe and distributes it at an elevated outlet position. The tube 16 terminates at a higher location to distribute the flowing water near the top of the pipe. As viewed again in FIG. 1 of the drawings, the numeral 24 identifies a tube which removes stratified water from the bottom of the pipe at the left and delivers it to the right, and also at a raised outlet discharge. There is no predetermined pattern for the distribution of the numerous tubes across the pipeline. As a generalization, they all collectively join together so that the liquid flow captured at the bottom of the pipe is directed into the several tubes. As a generalization, they are all collectively of substantial length and randomly distribute entrained droplets at elevated locations across the width of the pipe.

Assume for purposes of discussion that the water accumulates to a height of about 1 or 2 inches in a 12 inch pipeline. In that instance, the number of tubes receiving the water can vary but it is anywhere between about 5 (at a minimum) up to about 25 tubes in part depending on tube diameter and in part dependent on the spacing between the tube inlets. Tubes are joined together by tack welding at the inlet ends. The several tubes, whether 5 or 25, have substantial length along the pipeline, all terminating in common at 20. Here, it is helpful that the tubes have a specified minimum length to diameter ratio. If the tubes are exceedingly short, they become unduly steep while extending upwardly. Therefore it is desirable that the tubes be fairly long to reduce the slope. In this regard, the tubes should have a ratio of about 12:1 at a minimum and ideally about 20:1 as an optimum. Greater lengths do not generally provide further enhancement in performance. Performance relates primarily to be ability of the tubes to deliver water droplets from the bottom portion to the top of the pipe. Droplets enter each of the tubes and are forced along the tubes by the continuous petroleum flow from left to right. Water droplet migration includes this redistribution to the upper portions of the pipe 12.

The tube inlets fully cover the cross-sectional area of the pipe. The several inlets collectively comprise the entire cross-sectional area of the pipe substantial re-routing of the individual tubes to upper portions of the pipe is shown in FIG. 2.

While FIGS. 1 and 2 show only a few tubes, the preferred embodiment uses a set of tubes which fully cover the cross sectional area of the pipeline. The several tubes have a cross-sectional area equal to the area of the pipeline. This construction enables the entire volumetric flow of oil and water to be mixed so that water from the bottom is picked up from the bottom and redistributed into the full width of the pipeline. The several small tubes require some room to enable redistribution. This suggests that the pipeline be increased in diameter to enable the several small tubes to be positioned in serpentine fashion for flow redistribution. This enlarged diameter pipeline construction is discussed with regard to FIG. 3.

MIXING BY THE ASSEMBLY OF TUBES

The pipeline is plugged with the entire assembly of tubes. The several tubes collectively input all of the flow of the pipeline so that all of the flowing liquid is directed into the several tubes. The tubes provide a cumulative flow capacity sufficient to direct the flow into the many tubes and enable mixing.

One aspect of the present invention is the fact that the tubes are welded to adjacent tubes and the bundle of tubes is firmly attached by welding to the pipe wall. The entire tube assembly is attached so it is fixed and immovable. The nest of tubes must be anchored so that possible movement is prevented. Indeed, the entire assembly would function as a plug if the aggregate cross-sectional area were to small. The total cross-sectional area is sufficient in view of the flow rate so that the tube assembly does not move. The preferred method of attachment is welding at the edge of the tubes contacting the pipe, preferably at sufficient locations to properly anchor the assembly in a fixed condition.

Going now to FIG. 3 of the drawings, an alternate embodiment is illustrated at 30. In this embodiment, the pipe is modified by incorporation of an enlarged section 32. For instance, if the pipe has a nominal ID of 10 inches, the bulge can readily be adequate by adding a 10 or 20% increase in diameter. Moreover, this enables an increased volume so that the flow through the pipe is not impeded by the numerous tubes 34 which are included in the enlarged section. As before, several tubes are positioned across the area of the pipe. They are grouped at the common inlet (FIG. 1 of the drawings) which shows many individual tubes. FIG. 3 has been simplified by illustration of only two tubes and shows a mechanism for support of the tubes. In the embodiment of FIG. 1, the common inlet ends of the tubes at 18 are welded together by welding one tube to the other. They can also be tack welded to the surrounding pipe. In the embodiment shown in FIG. 3 of the drawings, the tube 34 along with the other tube 36 is supported by a transverse woven mesh 38 and a similar woven mesh 40 at the opposite end. These two mesh support members are included for the purpose of holding the tubes in space. All of the tubes are held in place by the two end supporting members 38 and 40. The perforated support members have openings which are sized to enable the ends of the tubes to be held in position. It is desirable that the tube OD be selected so that the support members grip the tube. This assures that the tubes does not move during assembly. Each tube is anchored by the grip at both ends.

As further shown in FIG. 3 of the drawings, the enlargement in the pipe accommodates many of tubes which are arranged in serpentine fashion. They collectively redirect the stratified flow in the pipe so that the flow is distributed at various locations in the cross-sectional area of the pipe, thereby assuring a more uniform distribution. Between the two support members 38 and 40, a curable epoxy resin or similar material is placed in the enlargement to bill all the spaces between the two support members to fill the space on the outside of the tubes. In other words, the pipeline is plugged by casting a plug in the enlargement. The plug is cured to hardness at which time the several tubes are held in place by the surrounding plug. This grip on the tubes can readily replace the grasp of the support members 38 and 40. Indeed, the grasp is superior and enables the support members 38 and 40 to be removed if desired. The solid cast plug is sufficient in all respects to hold the tubes in place.

The solid plug prevents flow except to the extent permitted by the several tubes. By selecting the right number of tubes, having a desired cross-sectional area, flow capacity of the pipeline is not reduced. In this event, it is possible to use several tubes of circular configuration mixed with several tubes which are not necessarily circular at the ends. Relatively thin well metal tubes can be used so that modest deformation of the wall permit greater crowding of the tubes into a set of inlets and outlets providing the intended throughput.

As an alternative approach the set of tubes can be made Of a heat sensitive material to enable heat to destroy the tubes by dissolving or melting the tubes. Once the plug material fills the chamber in the pipeline and cures, the thin walled tubes can be removed by heated solvent flow, leaving a solid body having a set of tubes. Here, the word "tubes" refers to the tube created passages in the cured and hardened plug. Even though the original tubes are removed, the tubes are still effectively present in the form of tube shaped passages. In the claims which follow, the word tubes refers to both forms of tubes.

An important aspect of the present system is the fact that the number of tubes can be varied. Indeed, as the tubes increase in number, the diameter can decrease for many or most of the tubes. Indeed, the tubes do not need to be uniform in area or made from the same diameter stock. As noted, FIG. 1 shows a large number of tubes and the number can be increased or decreased depending on requirements. As a generalization, a large number of tubes is helpful to provide assurance of redistribution of the water droplets into the higher part of the pipe. No pressure differential exists across the wall of the several tubes and the tubes are therefore preferably fabricated of relatively thin wall material.

While the foregoing is directed to the preferred embodiment, the scope is determined by the claims which follow.

I claim:

1. A method of mixing a liquid flow in a pipeline comprising the steps of:

(a) positioning, in a pipeline, upstream of a sampling device, a multiple set of small diameter tubes, wherein the tubes each have an upstream inlet and extend to a downstream outlet;

(b) directing a petroleum flow along the pipeline subject to water production so that water collects in the bottom of the pipeline;

(c) arranging the several tube inlets so that water flow in the pipeline is directed into the tubes at the inlet ends; and (d) extending the tubes along the pipeline so that the outlet ends thereof deliver water flow from the bottom of the pipeline to heights above the bottom so that flowing liquid carries entrained water droplets to enable sampling with a mixture of water droplets in the liquid.

2. The method of claim 1 including the step of attaching the set of tubes with inlets at a common point along the pipeline and extending the tubes to mixed and raised outlet locations in the pipeline.

3. The method of claim 2 including the step of welding the tubes together at the inlet end so that the water flow in the pipeline is directed into the tubes.

4. The method of claim 2 including the step of selecting small diameter tubes which have a length to diameter ratio of at least about 12:1.

5. The method of claim 1 including the step of attaching the set of tubes with inlets across the bottom of the pipeline to encompass the cross-sectional area of the pipeline wherein the several inlets collectively gather the water flow along the bottom of the pipeline which is directed into the inlet ends of the tubes.

6. The method of claim 5 wherein the small diameter tubes are collectively supported by an upstream support member which positions the inlet end of said tubes at a desired location with respect to the bottom of the pipeline, and wherein a second support member is positioned downstream of the inlet end to position the outlet ends of said tubes at desired elevations in the pipeline.

7. The method of claim 1 including the step of supporting an individual small diameter tube by upstream and downstream transversely positioned members so that said tube extends through said upstream and downstream meshes.

8. The method of claim 7 including the step of selecting small diameter tubes which have a length to diameter ratio of at least about 12:1.

9. The method of claim 1 wherein the multiple set of small diameter tubes are constructed and arranged so that the inlet ends collectively direct all of the water flow along the bottom of the pipeline into the tubes, and the outlet ends thereof terminate at different heights in the pipeline so that flowing liquid traveling along the pipeline urges the water through the tubes to form entrained droplets downstream of the tube outlets.

10. The method of claim 1 including the steps of:

(a) positioning the tubes in a desired serpentine pattern along the pipeline; and (b) casting a solid body in the pipeline on the exterior of the tubes to hold the tubes in place.

11. The method of claim 10 including the steps of removing the tubes from the cast solid body to leave a set of tube defined openings into and through said cast solid body.

12. The method of claim 11 wherein the tubes have a cross-sectional area to carry pipeline throughput.

13. An apparatus for use in sampling gas flow in a pipeline wherein the apparatus is installed upstream of a sampling mechanism and comprises a set of small tubes having inlet ends and outlet ends, and wherein said inlet ends are constructed and arranged to direct water flowing along the bottom of the pipeline into said tubes, and wherein said tubes extend along the length of said pipeline, and further wherein the outlet ends are positioned at various heights across the pipeline to redistribute water flowing along the bottom of the pipeline in the pipeline to form entrained water droplets and to provide a more uniform distribution of water droplets flowing along the pipeline.

14. The apparatus of claim 13 wherein said tubes having inlets and outlets are jointly positioned and held together to position the inlet ends as a group so that the water flow along the bottom of the pipeline is directed into said tubes, and further wherein said tubes have sufficient lengths to enable said tubes to redirect flowing water in said tubes into droplets distributed from the height of the cross-section area of the pipeline.

15. The apparatus of claim 14 wherein said tubes comprise at least two in number and said tubes are supported by upstream and downstream transversely positioned members having openings therein to permit flowing fluid in the pipeline to flow there through and further wherein said members include openings therein which support and enable said tubes to be held in a requisite position in space where the inlet ends are located at the bottom of the pipeline together flowing water in the pipeline and the outlet ends extend to selected heights in the pipeline to distribute liquid flowing through said tube as entrained water droplets across the cross-sectional area of the pipeline.

* * * * *